US012790910B1

(12) United States Patent
Ford et al.

(10) Patent No.: US 12,790,910 B1
(45) Date of Patent: Nov. 10, 2026

(54) INFINITE ROTATION RATCHET ASSEMBLY FOR SUBSEA TUBING HANGER ALIGNMENT

(71) Applicant: FMC Kongsberg Subsea AS, Kongsberg (NO)

(72) Inventors: Graham Ford, Holmestrand (NO); Firat Karadeniz, Kongsberg (NO); Øystein Ellefsen, Kongsberg (NO); Frank Wergeland, Erdal (NO); Marcel Rozek, Cracow (PL)

(73) Assignee: FMC Kongsberg Subsea AS, Kongsberg (NO)

( * ) Notice: Subject to any disclaimer, the term of this patent is extended or adjusted under 35 U.S.C. 154(b) by 0 days.

(21) Appl. No.: 19/313,386

(22) Filed: Aug. 28, 2025

(51) Int. Cl.
*E21B 33/043* (2006.01)

(52) U.S. Cl.
CPC ..... *E21B 33/043* (2013.01)

(58) Field of Classification Search
CPC ..... E21B 33/043
See application file for complete search history.

(56) References Cited

U.S. PATENT DOCUMENTS

| | | | | |
|---|---|---|---|---|
| 3,901,546 | A * | 8/1975 | Piazza | E21B 43/10 294/86.15 |
| 5,255,746 | A * | 10/1993 | Bridges | E21B 33/043 166/348 |
| 2011/0232474 | A1* | 9/2011 | Geiger | E21B 33/06 91/159 |
| 2015/0259990 | A1* | 9/2015 | June | E21B 33/038 166/341 |
| 2021/0180425 | A1* | 6/2021 | Bartlett | E21B 41/0021 |
| 2022/0127913 | A1* | 4/2022 | Armistead | E21B 17/07 |
| 2024/0426187 | A1 | 12/2024 | Spitz et al. | |

* cited by examiner

*Primary Examiner* — James G Sayre
(74) *Attorney, Agent, or Firm* — Erise IP, P.A.

(57) ABSTRACT

Systems, methods, and devices for orienting a tubing hanger in a subsea oil and gas well are described. In some embodiments, an infinite rotation ratchet assembly comprises first stage actuators, second stage actuators, an upper ratchet assembly, a lower ratchet assembly, and a brake assembly. The first stage actuators are configured to rotate a tubing hanger while components of the upper ratchet assembly rotate relative to the lower ratchet assembly and other components of the upper ratchet assembly are locked by the brake assembly. When a first actuator stroke is complete, the second stage actuators may return the first stage actuators to a pre-stroke condition while the tubing hanger is locked in place, allowing the first stage actuators to initiate a second stroke.

20 Claims, 10 Drawing Sheets

INFINITE ROTATION RATCHET ASSEMBLY FOR SUBSEA TUBING HANGER ALIGNMENT

BACKGROUND

1. Field

Embodiments of the present disclosure relate to an infinite ratchet and power transfer assembly. More specifically, embodiments of the present disclosure relate to an infinite ratchet and power transfer assembly for a subsea orientation system.

2. Related Art

In subsea well systems, such as, a vertical in the well (V-ITW) system, tubing hanger assemblies are typically installed using a tubing hanger orientation joint together with a blowout preventer (BOP) pin to orient them correctly relative to the template structure or permanent guide base (PGB). Rotation is achieved by lifting a string using a top drive component causing the BOP pin to interact against a helical interface on the string. Typical installation techniques calibrate the tubing hanger orientation joint prior to running the tubing hanger assembly subsea and then rely on the tubing hanger orientation joint and BOP pin to correctly orient the tubing hanger. If the tubing hanger is not properly aligned, rerunning completion or modification of the tree may be needed. Furthermore, the deeper the tubing hanger runs, the more out of alignment the tubing hanger can become. In some instances, at extreme depths, the tubing hanger could be 180-degrees or more out of alignment.

SUMMARY

Embodiments of the present disclosure solve the above-mentioned problems by providing systems, methods, and devices for providing infinite rotation of the tubing hanger for alignment with the undersea structures (e.g., template structure, PGB, or the like).

An embodiment of the current disclosure includes an infinite rotation ratchet assembly for a subsea tubing hanger orientation module. The infinite rotation ratchet assembly comprises an upper ratchet assembly comprising a first upper ring and a second upper ring. The infinite rotation ratchet assembly further comprises a lower ratchet assembly comprising a first lower ring operational to engage the first upper ring, a second lower ring operational to engage the second upper ring, and a spring configured to provide a spring force to the second lower ring to engage the second upper ring. The infinite rotation ratchet assembly further comprises a brake assembly configured to lock the first upper ring by pressing the first lower ring into the first upper ring, wherein when the brake assembly locks the first lower ring into the first upper ring, the second upper ring is configured to rotate relative to the second lower ring by compressing the spring.

An embodiment of the current disclosure includes a method of actuating an infinite rotation ratchet assembly of a subsea tubing hanger orientation module. The method comprises locking a first stage plate structure by engaging a first lower ring with a first upper ring using a brake assembly, actuating a first stage actuator from a pre-stroke configuration to press against the first stage plate structure thereby rotating a tubing hanger coupling structure, locking a second stage plate structure by engaging a second lower ring with a second upper ring using the brake assembly, and actuating a second stage actuator to press against the second stage plate structure thereby rotating the first stage plate structure thereby returning the first stage actuator to the pre-stroke configuration.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present disclosure will be apparent from the following detailed description of the embodiments and the accompanying drawing figures.

BRIEF DESCRIPTION OF THE DRAWING FIGURES

Embodiments of the present disclosure are described in detail below with reference to the attached drawing figures, where:

Figure 1:
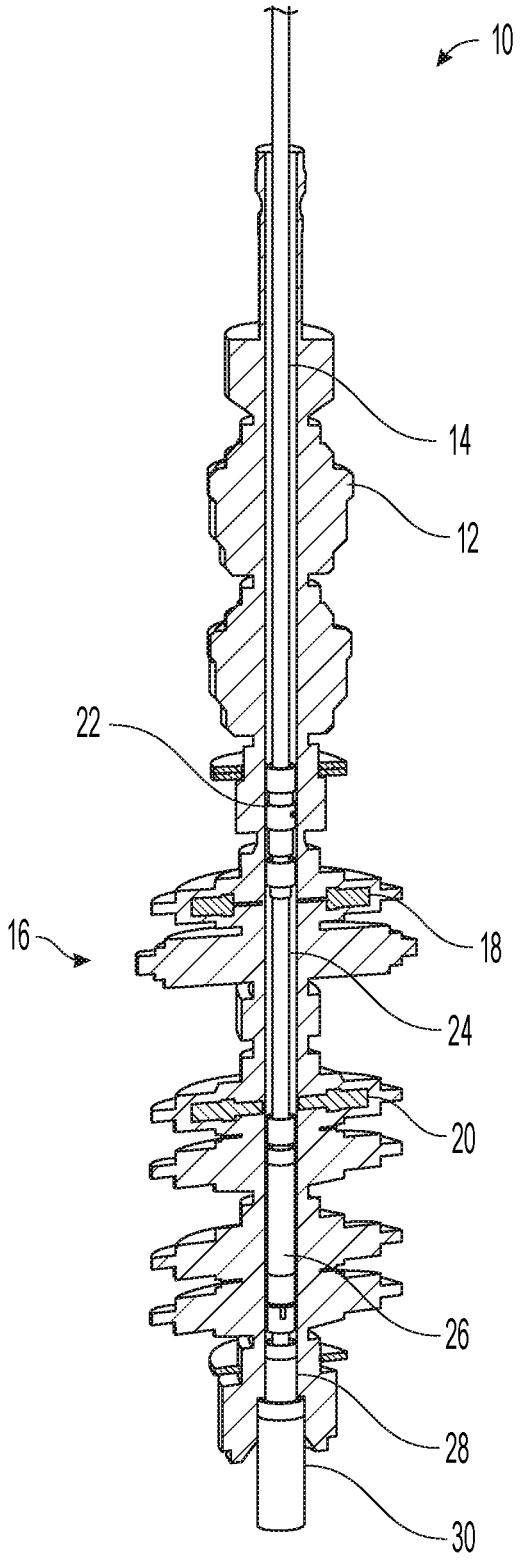
FIG. 1 illustrates an exemplary subsea well system relating to some embodiments of the present disclosure.

The drawing figures do not limit the present disclosure to the specific embodiments disclosed and described herein. The drawings are not necessarily to scale, emphasis instead being placed upon clearly illustrating the principles of the present disclosure.

DETAILED DESCRIPTION

The following detailed description references the accompanying drawings that illustrate specific embodiments in which the present disclosure can be practiced. The embodiments are intended to describe aspects of the present disclosure in sufficient detail to enable those skilled in the art to practice the present disclosure. Other embodiments can be utilized, and changes can be made without departing from the scope of the present disclosure. Therefore, the following detailed description is not to be taken in a limiting sense. The scope of the present disclosure is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc., described in one embodiment may also be included in other embodiments but is not necessarily included. Thus, the technology can include a variety of combinations and/or integrations of the embodiments described herein.

Generally, embodiments of the present disclosure relate to an infinite rotation (e.g., greater than 360-degrees) ratchet system configured to rotate a tubing hanger coupling structure thereby rotating a tubing hanger to orient the tubing hanger for securing in an undersea oil and gas structure. In some embodiments, the infinite rotation ratchet system comprises an upper ratchet assembly and a lower ratchet assembly. The lower ratchet assembly may be coupled to a brake assembly configured to lock components of the lower ratchet assembly to components of the upper ratchet assembly. A first stage of the upper ratchet assembly may actuate from a pre-stroke configuration to rotate the tubing hanger coupling structure while a second stage, or components thereof, of the upper ratchet assembly is locked. Next the brake assembly may engage the second stage locking the tubing hanger assembly structure and allowing the first stage to rotate back to a pre-stroke configuration. As such, the upper and lower ratchet assemblies may work in coordination to provide greater than 360-degrees of rotation to the tubing hanger coupling structure to orient the tubing hanger for placement in the oil and gas structure.

FIG. 1 illustrates an exemplary subsea well system 10 relating to some embodiments of the present disclosure. In some embodiments, subsea well system 10 is used to perform one or more operations on a subsea well. In some, riser 12 may comprise a system of large bore pipes and other structures that connect the subsea well system to surface equipment. A landing string 14 may be lowered down the riser 12. For example, the landing string 14 may be used to lower equipment down the bore of the subsea well system 10. In some embodiments, a blowout preventer (BOP) assembly 16 is included. The BOP assembly 16 may comprise a series of structures disposed around the internal bore to monitor and control well operation.

In some embodiments, the BOP assembly 16 includes one or more ram devices such as at least one shear ram 18 and at least one pipe ram 20, as shown. The shear ram 18 may be used to shear a pipe and isolate at least a portion of the well system. The pipe ram 20 may be operable to close an annular space between the wellbore and pipe. In some embodiments, the BOP assembly 16 comprises a plurality of sections. For example, the BOP assembly 16 may comprise an upper section and a lower section, such as a lower marine riser package (LMRP) and a system of shearing and sealing rams, respectively. In some embodiments, the BOP assembly 16 may include any combination of additional components not explicitly shown, such as, for example, blind rams, electrical lines, hydraulic lines, control units, and valves.

In some embodiments, a tubing hanger orientation assembly is included, which may be coupled to the landing string 14. For example, the tubing hanger orientation assembly may be lowered down through the riser 12 along with the landing string 14 within the internal bore. In some embodiments, the tubing hanger orientation assembly comprises a tubing hanger orientation device, assembly, or system similar to that described in U.S. application Ser. No. 18/906,612, titled "HIGH TORQUE ACCTUATED TUBING HANGER ORIENTATION"; and U.S. application Ser. No. 18/906,891, titled "LOW TORQUE ACCUTATED TUBING HANGER ORIENTATION", both of which are hereby incorporated by reference in their entirety into the present disclosure. Furthermore, in some embodiments, the tubing hanger orientation assembly comprises a brake assembly described in U.S. application Ser. No. 19/313,431, titled "FAIL-SAFE BRAKE ASSEMBLY", which is also hereby incorporated by reference in its entirety into the present disclosure.

In some embodiments, the landing string 14 further comprises a connector portion 24 coupled to a lower end of the tubing hanger orientation assembly operable to couple the tubing hanger orientation assembly to one or more lower components of the string assembly. The connector portion 24 may be used as a vertical spacer to vertically displace one or more components of the string assembly. However, it should be understood that embodiments are contemplated in which the connector portion 24 is not included.

In some embodiments, the connector portion 24 comprises one or more communication components such as an in-riser communication system operable to provide any combination of data transfer, control signals, and power transmission between components of the string assembly and surface equipment. In some embodiments, the in-riser communication system comprises any suitable communication means such as any of optical communication lines, electrical communication lines, or hydraulic communication lines.

In some embodiments, the string assembly further comprises a tubing hanger running tool 26 operable to position a tubing hanger 28 within the subsea well system 10. For example, the running tool 26 may be configured to position the tubing hanger 28 within the internal bore in order to couple the tubing hanger 28 to a wellhead 30.

Figure 2:
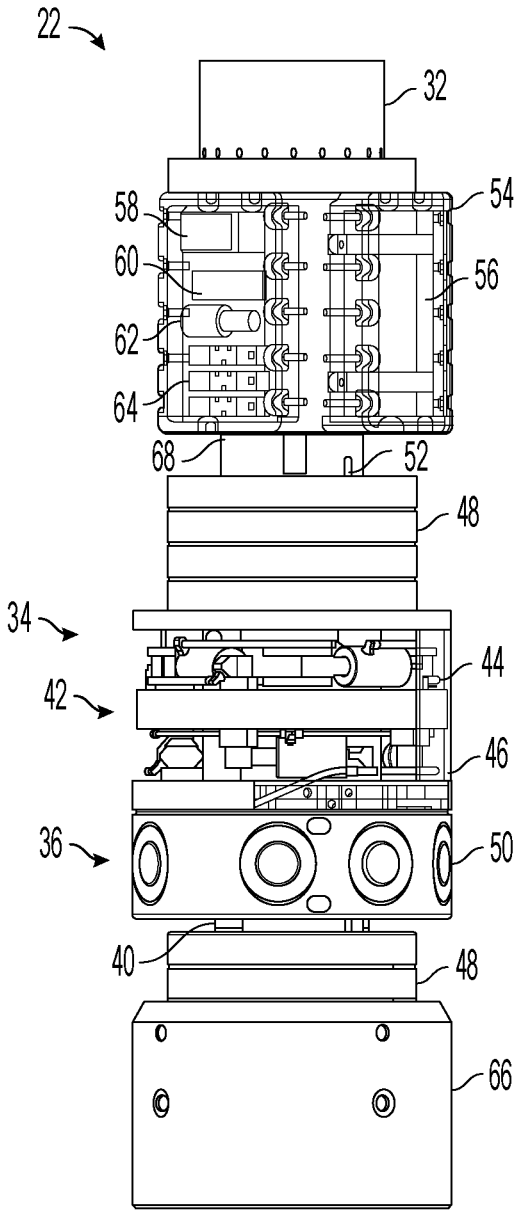
FIG. 2 illustrates an exemplary subsea orientation module relating to some embodiments of the present disclosure.

FIG. 2 illustrates an embodiment of tubing hanger orientation assembly 22 relating to some embodiments of the present disclosure. The tubing hanger orientation assembly 22 comprises a tubing hanger running connector portion 24 (FIG. 1) and an adapting structure 66. The adapting structure 66 may include a nut for adapting the tubing hanger running connector portion 24 to one or more other components. The tubing hanger running connector portion 24 may be secured to the landing string 14 and therefore does not move relative to the landing string 14 and tubing hanger 28. As such, in embodiments described below, the tubing hanger orientation assembly 22 may engage portions of the landing string 14 and tubing hanger running connector portion 24 to rotate tubing hanger 28.

The tubing hanger orientation assembly 22 further includes infinite rotation ratchet assembly 34. Infinite rotation ratchet assembly 34 includes brake assembly 36 including one or more pistons and vertically oriented standoff piston 40. The standoff piston 40 may be operable to provide and maintain a vertical clearance to allow upward stroking of the tubing hanger orientation assembly 22. Infinite rotation ratchet assembly 34 further includes actuator assembly 42 operable to drive rotation of components of the tubing hanger orientation assembly 22 relative to fixed points of the brake assembly 36. In some embodiments, the actuator assembly 42 includes a multi-stage layout including first stage actuator array 44 and second stage actuator array 46. Accordingly, each actuator assembly stage is operable to rotate relative to the other stage based on a locking position of brake assembly 36. In some embodiments, a lower portion of the second stage actuator array 46 may be fixed to the brake assembly 36 and an upper portion of the first stage actuator array 44 may be fixed to the tubing hanger running connector portion 24.

In some embodiments, tubing hanger orientation assembly 22 includes a plurality of spacers 48. For example, one or more spacers 48 may be disposed above the infinite rotation ratchet assembly 34 and one or more spacers 48 may be disposed below the infinite rotation ratchet assembly 34. The plurality of spacers 48 may be disposed around an outer diameter of a longitudinal structure of the tubing hanger joint body. In some embodiments, the plurality of spacers 48 are moveable. For example, one or more spacers 48 may be removed from above infinite rotation ratchet assembly 34 and placed below infinite rotation ratchet assembly 34, or vice versa. Accordingly, the spacers 48 may be used to adjust a vertical positioning of infinite rotation ratchet assembly 34 with respect to the BOP assembly 16. For example, in some embodiments, the one or more spacers 48 are used to vertically adjust infinite rotation ratchet assembly 34 with respect to the BOP assembly 16 such that brake 50 is vertically aligned with a particular portion of the BOP assembly 16. Alternatively, or additionally, in some embodiments, brake 50 may be adjusted, for example, using the one or more spacers 48, to avoid a particular portion of the BOP assembly 16, such as, a slick section of an internal diameter of the BOP assembly 16 including a pipe ram cavity. Embodiments are contemplated in which radial pistons of the brake 50 are configured to extend and interface with at least one cavity of the BOP assembly 16 or interface with at least a portion of the BOP.

In some embodiments, tubing hanger orientation assembly 22 further includes a keyway 52 disposed into the longitudinal structure of the tubing hanger orientation assembly 22, as shown. The keyway 52 may be configured to receive one or more keys or pins to maintain an alignment of the exemplary tubing hanger orientation assembly 22 during vertical stroking. For example, the keyway 52 may be vertically elongated such that the keys or pins disposed therein are able to translate vertically but not tangentially to prevent further rotation of the exemplary tubing hanger orientation assembly 22 during vertical stroking.

Tubing hanger orientation assembly 22 further includes a control portion 54 operable to control one or more other devices of the tubing hanger orientation assembly 22, such as the actuator assembly 42 and the brake assembly 36. In some embodiments, a gyroscopic sensor 56 is disposed in the control portion 54. In some embodiments, the gyroscopic sensor 56 may be any of a gyroscope, a linear gyroscope, and may perform standard gyroscopic functions. For example, the gyroscopic sensor 56 may be configured to detect a rotational orientation of tubing hanger orientation assembly 22 or any component thereof.

In some embodiments, the control portion 54 includes any combination of a voltage converter 58, a controller board 60, a stepper pump 62, and one or more valves 64, such as solenoid operated hydraulic valves. In some embodiments, the one or more valves 64 are configured to control actuation of the brake assembly 36 and the actuator assembly 42 hydraulically. Embodiments are contemplated in which the controller board 60 is operable to control the one or more valves 64 to thereby hydraulically control the hydraulic actuators of infinite rotation ratchet assembly 34. However, it should be understood that other suitable forms of actuation are also contemplated, such as, for example, electric, pneumatic, or magnetic, as well as combinations thereof, and other forms of actuation not explicitly described herein.

Figure 3:
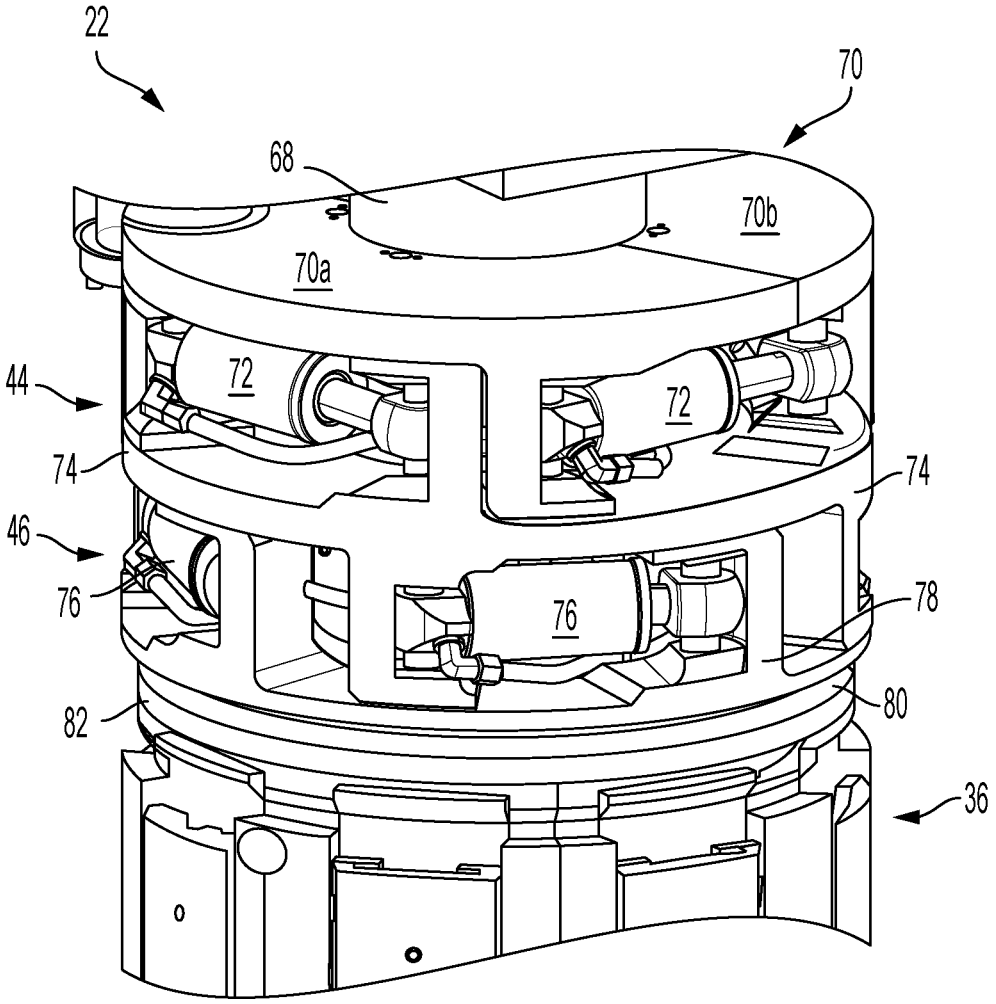
FIG. 3 illustrates an exemplary infinite ratcheting tubing hanger orientation assembly.

FIG. 3 illustrates some components of infinite rotation ratchet assembly 34. Here, infinite rotation ratchet assembly 34 is in a stroked position with first stage actuators 72 extended and second stage actuators 76 compressed. When first stage actuators 72 are compressed, infinite rotation ratchet assembly 34 is in a pre-stroked configuration. In the pre-stroked configuration first stage actuators 72 are configured to stroke when energy is supplied and rotate tubing hanger coupling structure 70. As described in detail below, first stage actuators 72 are operable to rotate tubing hanger coupling structure 70, longitudinal structure 68 (e.g., landing string 14 or tubing hanger running connector portion 24), and tubing hanger 28. In some embodiments, second stage actuators 76 are operable to reset first stage actuators 72 back to the pre-stroke configuration while tubing hanger coupling structure 70, longitudinal structure 68, and tubing hanger 28, are locked in place.

In some embodiments, the components of tubing hanger orientation assembly 22 are provided with a clam-shell layout. For example, brake assembly 36 and actuator assembly 42 may include two or more distinct sections that are configured to be disposed on opposing sides of the longitudinal structure 68 of tubing hanger orientation assembly 22. Here, tubing hanger coupling structure 70 comprises first coupling structure 70*a* and second coupling structure 70*b*. Accordingly, infinite rotation ratchet assembly 34 may be placed around the longitudinal structure 68 without removing end portions of the longitudinal structure 68. Instead, for example, two separate side structures (e.g., first coupling structure 70*a* and second coupling structure 70*b*) may be placed on opposing sides of the longitudinal structure 68 and fastened together. Furthermore, the description of separate structures here may be extended to brake assembly 36.

Continuing with the embodiment illustrated in FIG. 3, the exemplary actuator assembly 42 of infinite rotation ratchet assembly 34 relating to some embodiments of the present disclosure is depicted. The actuator assembly 42 includes the first stage actuator array 44 and second stage actuator array 46, as described above. Additionally, the actuator assembly 42 includes tubing hanger coupling structure 70, which may be fixed to the longitudinal structure 68, which may be landing string 14 or tubing hanger running connector portion 24 and is couple to tubing hanger 28. Furthermore, a plurality of first stage actuators 72 are included. Each of the plurality of first stage actuators 72 may be coupled at a first end to the tubing hanger coupling structure 70 and at a second end to a first stage plate structure 74. Accordingly, when actuated, and first stage plate structure 74 is locked, the plurality of first stage actuators 72 adjust rotation of the tubing hanger coupling structure 70 thereby rotating longitudinal structure 68 and tubing hanger 28 with respect to the first stage plate structure 74. In some embodiments, actuators described herein may be hydraulically actuated; however, it should be understood that embodiments are contemplated in which other suitable forms of actuation (e.g., electric, pneumatic, and mechanical) can be used.

The second stage actuator array 46 includes a plurality of second stage actuators 76. Each of the plurality of second stage actuators 76 is coupled at a first end to the first stage plate structure 74 and at a second end to a second stage plate structure 78. Accordingly, the plurality of second stage actuators 76, when actuated, adjust rotation of the first stage plate structure 74 with respect to the second stage plate structure 78 when the second stage plate structure 78 is locked by brake assembly 36 as described below. In some embodiments, each actuator of the plurality of first stage actuators 72 and the plurality of second stage actuators 76 includes a linear hydraulic piston operable to adjust a position between two points fixed to the ends of the respective hydraulic piston.

In some embodiments, the second stage plate structure 78 is fixed to, or couplable to, the brake assembly 36. Accordingly, the brake assembly 36 may be used to lock rotation of the second stage plate structure 78 with respect to the BOP assembly 16. Accordingly, during operation, the first stage plate structure 74 is rotated with respect to the BOP assembly 16 through actuation of the plurality of second stage actuators 76. During operation, the tubing hanger coupling structure 70 is further rotated with respect to the first stage plate structure 74 through actuation of the plurality of first stage actuators 72. Accordingly, in some embodiments, the actuator assembly 42 may be used to provide a rotational single stroke length of approximately 40 degrees. However, it should be understood that different stroke lengths are also contemplated for some embodiments. Furthermore, it should be noted that first stage actuator array 44 may rotate the tubing hanger 28 then second stage actuator array 46 may reset the first stage actuator array 44 ready for another stroke. Different types of rotary actuators are also contemplated. For example, in some embodiments, first stage actuators 72 and second stage actuators 76 may include a vane actuator with a rotational stroke length of approximately 100 degrees. In some embodiments, the first stage actuator array 44 and the second stage actuator array 46 are operable to couple to and rotate components of upper ratchet assembly 80 and couple to and rotate the tubing hanger 28 through locking components of lower ratchet assembly 82.

Figure 4:
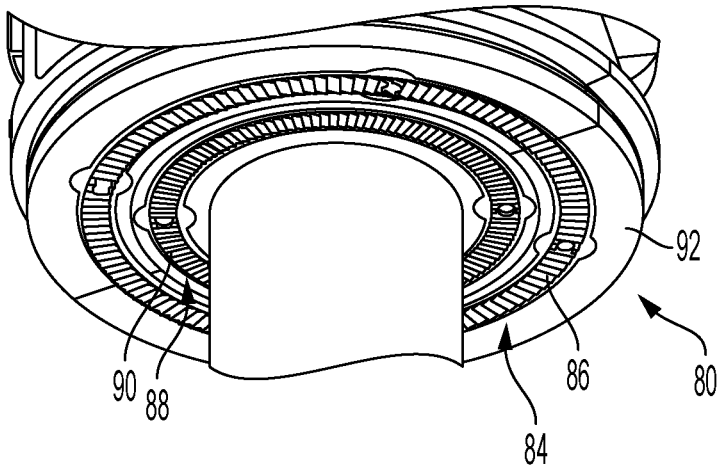
FIG. 4 illustrates an exemplary upper ratchet assembly.
Figure 5:
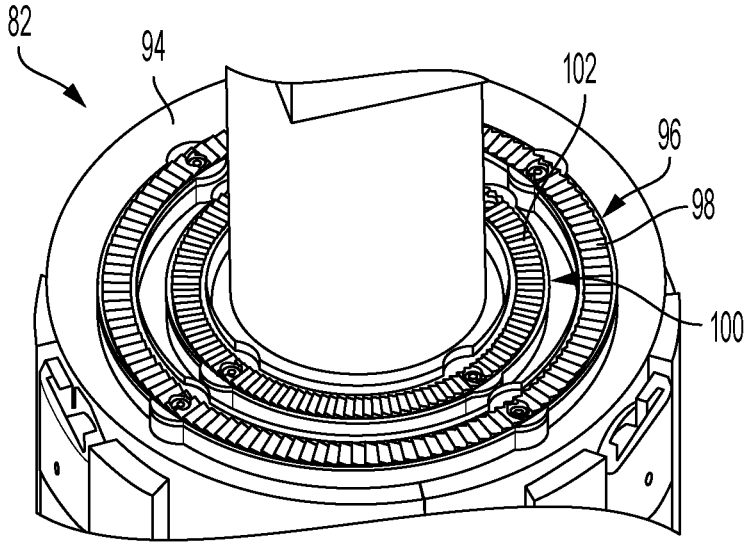
FIG. 5 illustrates an exemplary lower ratchet assembly.

FIG. 4 depicts upper ratchet assembly 80 and FIG. 5 depicts the corresponding lower ratchet assembly 82. Here, upper ratchet assembly 80 comprises upper ratchet housing 92 housing upper outer ring 84 comprising upper outer teeth 86 and upper inner ring 88 comprising upper inner teeth 90. Upper outer ring 84 may be coupled to first stage actuators 72 by first stage plate structure 74 and upper inner ring 88 may be coupled to second stage actuators 76 by second stage plate structure 78 or vice versa.

It should be understood that any arrangement may be designed. For example, upper outer ring 84 can be coupled to second stage plate structure 78 and upper inner ring 88 can be coupled to first stage plate structure 74. However, for consistency in the description herein, upper outer ring 84 is coupled to first stage actuators 72 by first stage plate structure 74 and upper inner ring 88 is coupled to second stage actuators 76 by second stage plate structure 78. Furthermore, it should be noted that the terms "upper" and "lower" are used for identification only. In some embodiments, infinite rotation ratchet assembly 34 may be placed horizontally, vertically, or at any angle. As such, the terms "upper" and "lower" are only to be taken as relative arrangements in the drawing figures.

Furthermore, the terms "inner" and "outer" relating to inner rings and outer rings may generally be referenced as "first" and "second." Here, outer rings are labeled "first" as the outer rings are coupled to first stage actuators 72 and inner rings are labeled as "second" as the inner rings are coupled to the second stage actuators 76; however, the description is again for convention and ease of description. In some embodiments, the term "first" can apply to inner rings and components thereof and the term "second" can apply to outer rings and components thereof.

FIG. 5 depicts lower ratchet assembly 82. In some embodiments, lower ratchet assembly 82 comprises lower ratchet housing 94 housing lower outer ring 96 and lower inner ring 100. Lower outer ring 96 comprises lower outer teeth 98, and lower inner ring 100 comprises lower inner teeth 102. In some embodiments, upper outer teeth 86 may engage lower outer teeth 98, and upper inner teeth 90 may engage lower inner teeth 102 to transfer force therebetween. The transfer of force between the teeth may, in some embodiments, transfer force produced by first stage actuators 72 and second stage actuators 76 to rotate tubing hanger coupling structure 70 to rotate tubing hanger 28 described in detail below. Furthermore, lower inner ring 100 and lower outer ring 96 may be rotationally fixed but may move up and down to engage and disengage upper ratchet assembly 80. As such, lower inner ring 100 and lower outer ring 96 may be operable to lock upper inner ring 88 and upper outer ring 84 and components thereof.

Figure 6:
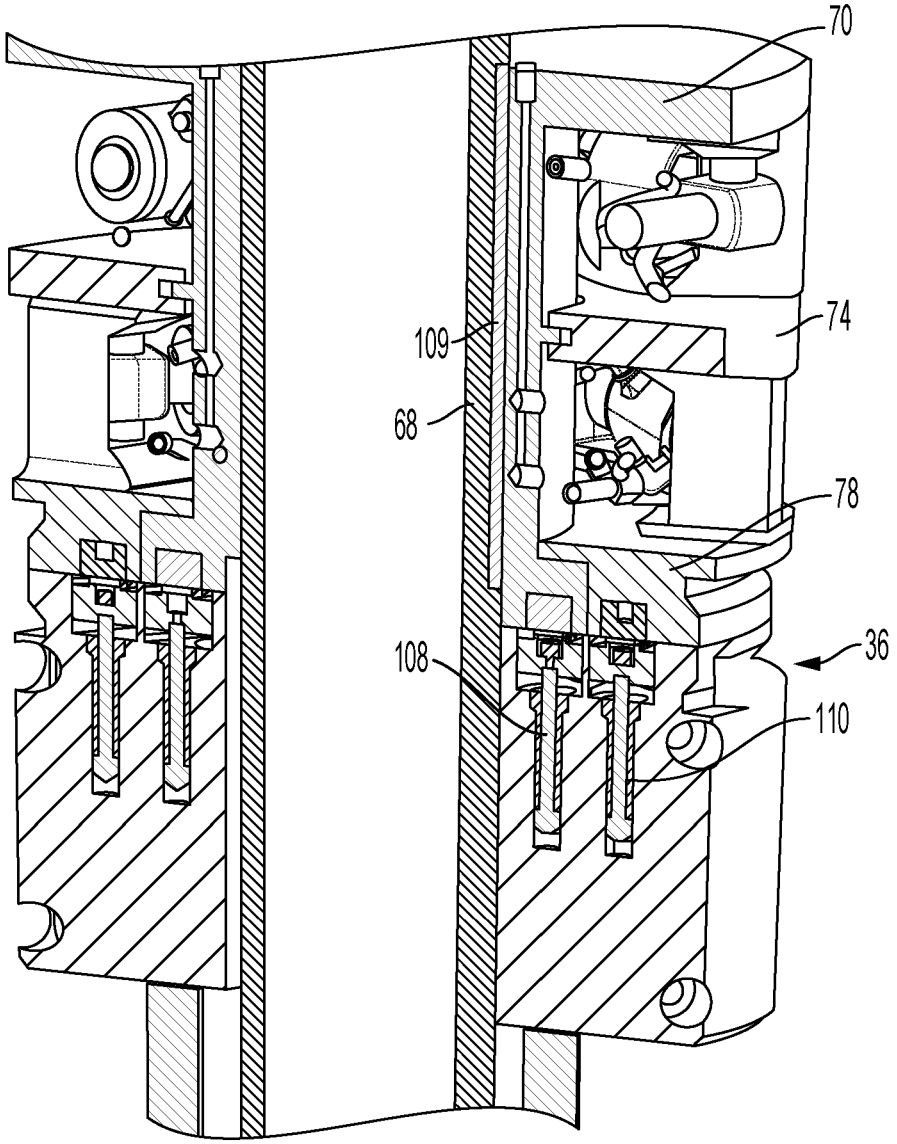
FIG. 6 illustrates a cross-section view of the exemplary ratchet assembly and an exemplary brake assembly.

FIG. 6 depicts a cross-section view of an exemplary embodiment of infinite rotation ratchet assembly 34 illustrating the interactions between first stage plate structure 74, tubing hanger coupling structure 70, and longitudinal structure 68, and the interactions between lower ratchet assembly 82 and brake assembly 36. Here, first stage plate structure 74 is coupled to upper outer ring 84. As illustrated in in FIG. 8 and described in detail below, as brake assembly 36 locks first stage plate structure 74 in place via lower outer ring 96 engaging and locking upper outer ring 84, first stage actuators can actuate, reacting against locked first stage plate structure and rotating tubing hanger coupling structure 70, inner body 109 (coupling tubing hanger coupling structure 70 to longitudinal structure 68), longitudinal structure 68, and tubing hanger 28. In some embodiments, the stroke of first stage actuators 72 is approximately 40 degrees. As such, during one single stroke, tubing hanger 28 may rotate up to 40 degrees. However, in some embodiments, the stroke may be greater than 40 degrees. However, as first stage actuators 72 may be reset, multiple strokes may be made resulting in tubing hanger 28 orientation being rotated by up to and beyond 360 degrees.

In some embodiments, first stage actuators 72 can be reset to the pre-stroke configuration by the second stage actuators 76. As the brake assembly 36 locks the second stage plate structure 78 via inner rings, the second stage actuators 76 can react against the locked second stage plate structure 78 rotating the first stage plate structure to a starting position relative to first stage actuators 72. As such, first stage actuators 72 can be reset in the pre-stroke configuration (e.g., compressed) ready to apply another stroke to the tubing hanger coupling structure 70. The interaction between the brake assembly 36 with lower ratchet assembly 82 is described in more detail below.

Figure 7A:
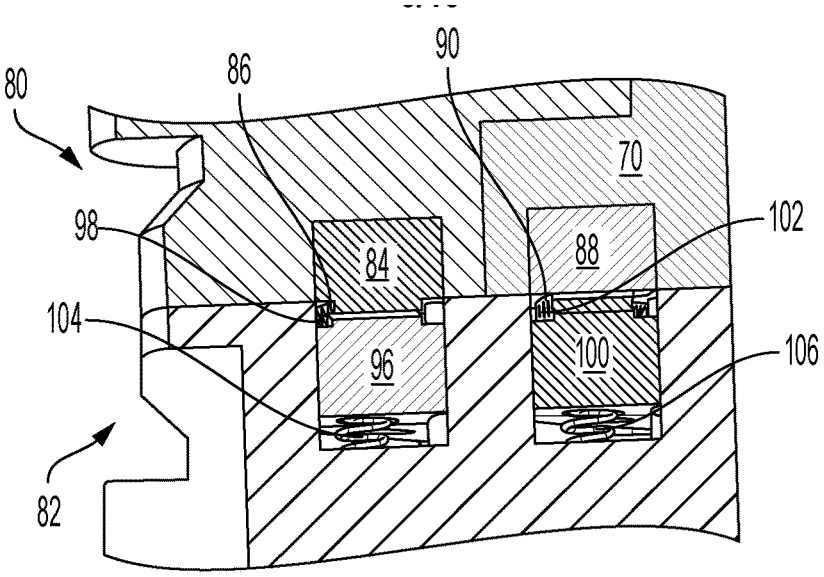
FIG. 7A illustrates an exemplary spring assembly of the lower ratchet assembly.
Figure 7B:
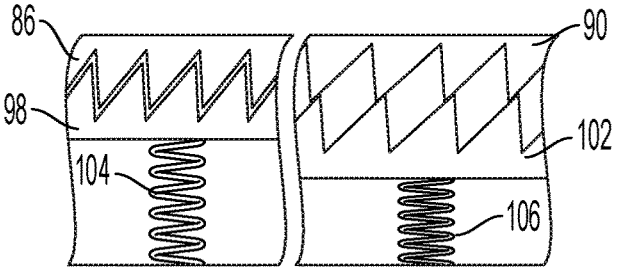
FIG. 7B illustrates a close-up view of the exemplary spring assembly of FIG. 7A.

FIGS. 7A and 7B depict an exemplary interaction between upper ratchet assembly 80 and lower ratchet assembly 82 providing an infinite rotation ratchet system operable to rotate tubing hanger 28 up to and beyond 360 degrees. In some embodiments, upper ratchet assembly 80 comprises upper outer ring 84 comprising upper outer teeth 86 and upper inner ring 88 comprising upper inner teeth 90. Furthermore, lower ratchet assembly comprises lower outer ring 96 comprising lower outer teeth 98 and lower inner ring 100 comprising lower inner teeth 102. Furthermore, lower ratchet assembly 82 comprises inner spring 106 and outer spring 104, which, as described above, may generally be referenced as first spring and second spring.

In some embodiments, upper inner teeth 90, upper outer teeth 86, lower inner teeth 102, and lower outer teeth 98 comprise a series of protrusions and recesses defined by faces provided at an angle on a first side and flat (e.g., vertical) on a second side opposite the first side as shown in FIG. 7B. Therefore, each tooth comprises a flat side and an angled side. Each flat side of the teeth of the lower ratchet assembly 82 may contact the flat side of the teeth of the upper ratchet assembly 80 providing a surface area in contact. The surface area in contact is configured to transfer force between the upper ratchet assembly 80 and the lower ratchet assembly 82. As illustrated in FIG. 7B, upper outer teeth 86 and lower outer teeth 98 are in contact on the flat face of the teeth. As force is applied to upper outer ring 84 by first stage actuators 72 described above, upper outer ring 84 may be locked into lower outer ring 96 providing a surface to react against to rotate tubing hanger coupling structure 70. Here, upper outer teeth 86 of upper outer ring 84 impart a force to lower outer ring 96 approximately equal and opposite to the force imparted by first stage actuators 72 on tubing hanger coupling structure 70. The brake assembly 36 (described in detail below and illustrated in FIG. 8) locks the lower outer ring 96 to the upper outer ring 84.

As upper ratchet assembly 80 is rotated by the interaction between the outer rings, inner rings react against the angled sides of upper inner teeth 90 and lower inner teeth 102 compressing inner spring 106 as shown FIG. 7B. As shown, inner rings are not engaged by the brake assembly 36. As such, upper inner ring 88 rotates lower inner ring 100 is forced downward (as shown) by the force applied by upper inner teeth 90 angled surfaces providing a horizontal force component and a vertical force component to the angled surface of lower inner teeth 102. The vertical force component compressing inner spring 106 allowing upper inner teeth 90 move past lower inner teeth 102.

Furthermore, in some embodiments, to reset the first stage actuators 72, the second stage actuators 76 may run the ratchet assembly again or in the opposite direction when inner brake 108 (FIG. 8) of the brake assembly 36 is applied to the lower inner rings 100, and the outer spring 104 is compressed while the first stage actuators 72 reset to the pre-stroke configuration. In an exemplary second motion, once the first stage actuators 72 are fully stroked, the upper outer ring 84, coupled to the first stage actuators 72 may be released from the outer brake 110. Next, the brake assembly 36 may actuate inner brake 108 to engage the lower inner ring 100 locking the upper inner ring 88 in place and therefore locking the second stage plate structure 78 in place. As such, the second stage actuators 76 can actuate in the opposite direction against the second stage plate structure 78 forcing the first stage plate structure 74 and therefore, first stage actuators 72 back to the pre-stroke configuration resetting the first stage actuators 72 for a second stroke.

Figure 8:
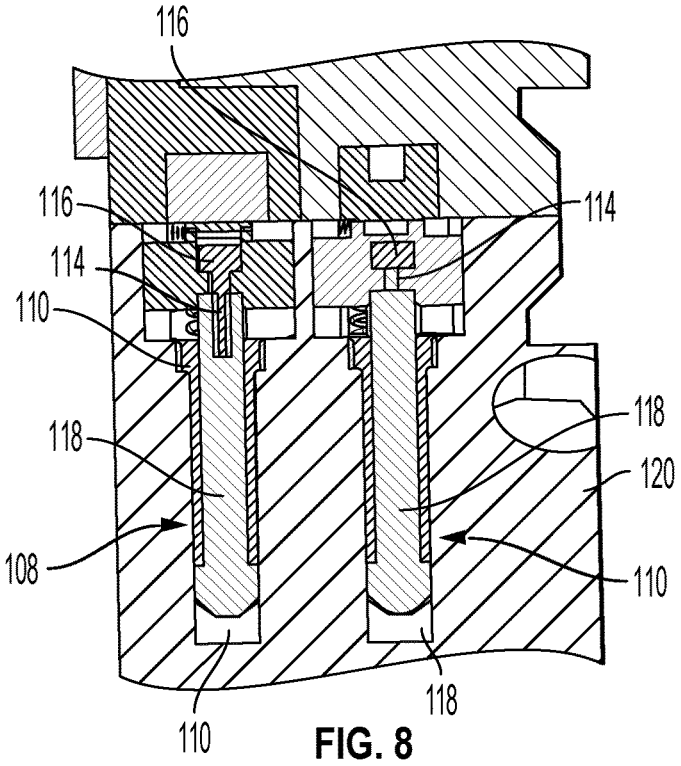
FIG. 8 depicts an exemplary brake assembly for some embodiments of the disclosure.

FIG. 8 depicts an embodiment of brake assembly 36. Here, brake assembly 36 comprises a brake housing 120. For example, the brake housing 120 may include a rigid structure operable to support one or more internal components of the brake assembly 36. In some embodiments, the brake assembly 36 comprises a plurality of brake actuator assemblies. For example, each brake actuator assembly may comprise a brake piston 114, a brake pad 116 joined to the brake piston 114, and a brake cylinder 118 through which the brake piston 114 is disposed. During actuation, the brake piston 114 may translate through the brake cylinder 118 and protrude out of the brake cylinder 118 to interface with the lower rings provide brake engagement, for example to lock rotation of the upper rings. In some embodiments, each brake cylinder 118 comprises a brake cylinder chamber which defines an opening or cavity operable to receive the brake piston 114. In some embodiments, the brake cylinder chamber includes a sealed pressure chamber. The brake assembly is described in more detail in U.S. application Ser. No. 19/313,431, titled "FAIL SAFE BRAKE ASSEMBLY" referenced above.

Figure 9A:
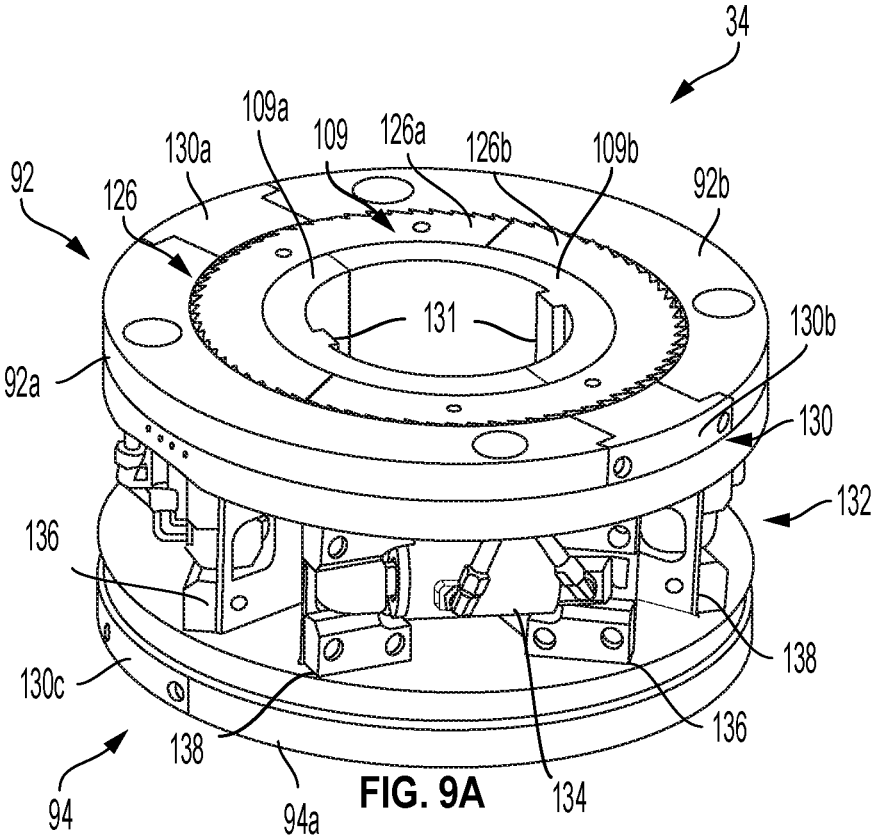
FIGS. 9A-9C depict exemplary components of a rotary configuration of the infinite rotation ratchet assembly.
Figure 9B:
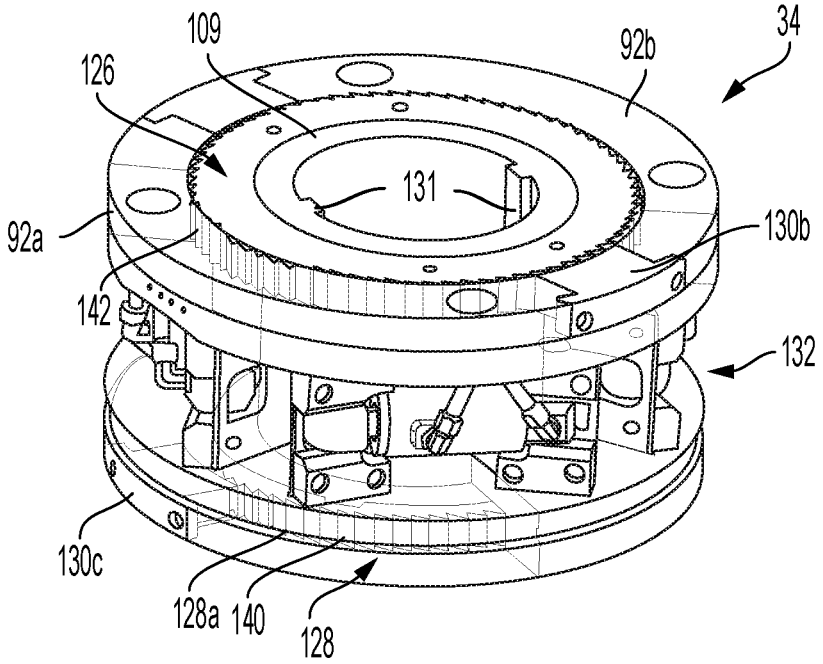

FIGS. 9A-9B depict an embodiment of infinite rotation ratchet assembly 34 comprising upper ratchet housing 92 comprising first upper ratchet housing 92*a* and second upper ratchet housing 92*b*, and lower ratchet housing 94 comprising first lower ratchet housing 94*a* and second lower ratchet housing (not shown). Infinite rotation ratchet assembly 34 further comprises upper ratchet ring 126 comprising first upper ratchet ring 126*a* and second upper ratchet ring 126*b*, and lower ratchet ring 128 comprising first lower ratchet ring 128*a* and second lower ratchet ring (not shown). Infinite rotation ratchet assembly 34 further comprises inner body 109 comprising first inner body 109*a* and second inner body 109*b* coupling infinite rotation ratchet assembly 34 to longitudinal structure 68 as described in embodiments above. Furthermore, infinite rotation ratchet rotation assembly 34 comprises actuator array 132, including actuators 134. Here, actuator array 132 may be, or may be similar to, first stage actuator array 44 and second stage actuator array 46 described above. Here, in some embodiments, actuators 134 may be cylinders comprising double-action pistons. As such, actuators 134 may be operable to stroke in two opposing directions, for some embodiments described below.

In some embodiments, infinite rotation ratchet assembly 34 comprises ratchet cartridges 130. Here, two upper ratchet cartridges 130*a*, 130*b* are disposed on upper ratchet housing 92, and two lower ratchet cartridges (e.g., lower ratchet cartridge 130*c*) are disposed on lower ratchet housing 94. However, any number of ratchet cartridges 130 may be disposed on upper ratchet housing 92 and lower ratchet housing 94. Furthermore, infinite rotation ratchet assembly 34 may comprise keys 131 selectively locking components of the infinite rotation ratchet assembly 34 to longitudinal structure 68. Furthermore, in some embodiments, ratchet cartridges 130 may provide interaction between ratchet housing 92, 94 and ratchet rings 126, 128. Ratchet cartridges 130 include ratchet cartridge teeth 146 that interact with the teeth of upper ratchet housing 92 and lower ratchet housing 94 transferring torque from ratchet housing 92, 94 to ratchet rings 126, 128.

In some embodiments, the components of infinite rotation ratchet assembly 34 are operable to actuate actuators 134 to rotate inner body 109 and longitudinal structure 68, then reset at least some components to an initial position while holding inner body 109 and longitudinal structure 68 to prepare to rotate again. As such, infinite rotation ratchet assembly 34 may rotate from an initial position to an extended position, or a full stroke position based on the stroke of the actuators 134. This may be referenced as a rotating action herein. Furthermore, actuators 134 reset the infinite rotation ratchet assembly 34 back to the initial position in a resetting action while holding the longitudinal structure 68 in preparation of rotating longitudinal structure 68 again. The process is then repeated to rotate the longitudinal structure 68 through any degrees necessary to align the longitudinal structure 68 with the tubing hanger 28.

In some embodiments, actuators 134 are operable to be pressurized and actuate in a first direction acting against upper ratchet housing brackets 136 coupled to upper ratch housing 92. Furthermore, actuators 134 are operable to be actuated in a second direction acting against lower ratchet housing brackets 138 coupled to lower ratchet housing 94. In some embodiments, upper ratchet housing 92, lower ratchet housing 94, upper ratchet ring 126, and lower ratchet ring 128 are configured to interact with brake assembly 36 as described in embodiments above. As such, each of upper ratchet housing 92, lower ratchet housing 94, upper ratchet ring 126, and lower ratchet ring 128 can be selectively coupled to inner body 109 and stationary relative to longitudinal structure 68 or allowed to rotate relative to longitudinal structure 68 depending on the brake assembly 36 and/or the direction of rotation. Herein, upper ratchet ring 126 and lower ratchet ring 128 are coupled to and decoupled from brake assembly 36 as described in embodiments above.

As actuators 134 extend pushing against upper ratchet housing 92, actuators 134 force movement of lower ratchet housing brackets 138, which are coupled to lower ratchet housing 94. As illustrated, when upper ratchet housing 92 is locked, lower ratchet housing 94 rotates and lower ratchet ring 128 rotates via the interaction between lower ratchet cartridges (e.g., lower ratchet cartridge 130*c*) and lower ratchet ring 128. In turn, lower ratchet ring 128 transfers the torque to inner body 109 that imparts the torque to longitudinal structure 68 via keys 131. As such, longitudinal structure 68 rotates based on the extension, or stroke, of actuators 134 during the rotating action. As described herein, and as illustrated in FIGS. 9A-9B, inner body 109 is rotated clockwise as an example; however, in some embodiments, infinite rotation ratchet assembly 34 may be operable to rotate the longitudinal structure 68 counterclockwise and reset (as described below) clockwise.

The rotation of inner body 109 is performed by transferring the torque provided by the actuators 134 through lower ratchet housing 94 through the cartridge teeth 146 (FIG. 9C) of lower ratchet cartridges (e.g., lower ratchet cartridge 130*c*) to lower ratchet ring 128 through lower radial ring teeth 140 (FIG. 9B). The torque in turn rotates inner body 109, which interfaces with the longitudinal structure 68 through keys 131 as described above. During the rotating process, in some embodiments, upper ratchet ring 126 rotates along with lower ratchet ring 128 and inner body 109. As such, upper ratchet cartridges 130*a*, 130*b*, compress (as described below) allowing upper ratchet ring 126 rotate inside of upper ratchet housing 92.

In some embodiments, lower ratchet ring 128 provides the torque from actuators 134 to allow the actuator array 132 to rotate inner body 109 clockwise. Once the inner body 109 action is complete, lower ratchet housing 94 can be "reset" by allowing lower ratchet housing 94 to rotate counterclockwise without rotating inner body 109 counterclockwise by locking upper ratchet ring 126. The resetting action is performed by again actuating actuators 134 when upper ratchet housing 92 is locked by brake assembly 36. Therefore, actuators 134 react against upper ratchet housing brackets 136. The actuators 134 here, as described above, comprise double-acting pistons. Therefore, actuators 134 act in the opposite direction. As upper ratchet housing 92 is stationary, lower ratchet housing 94 now rotates independently in the exemplary counterclockwise direction resetting to the initial position relative to upper ratchet housing 92. Inner body 109 rotated based on the length of the first stroke of actuators 134, while inner body 109 was held in place as actuators 134 provide a return stroke rotating lower ratchet housing 94 back to the initial position. It should be noted that the upper ratchet ring teeth 142 and lower ratchet ring teeth 140 interact with ratchet cartridges 130 to lock into ratchet cartridges 130 (in the clockwise direction) and slide over ratchet cartridges 130 (in the counterclockwise direction) as described above in reference to FIG. 7B and as described in more detail in reference to FIG. 9C below.

Figure 9C:
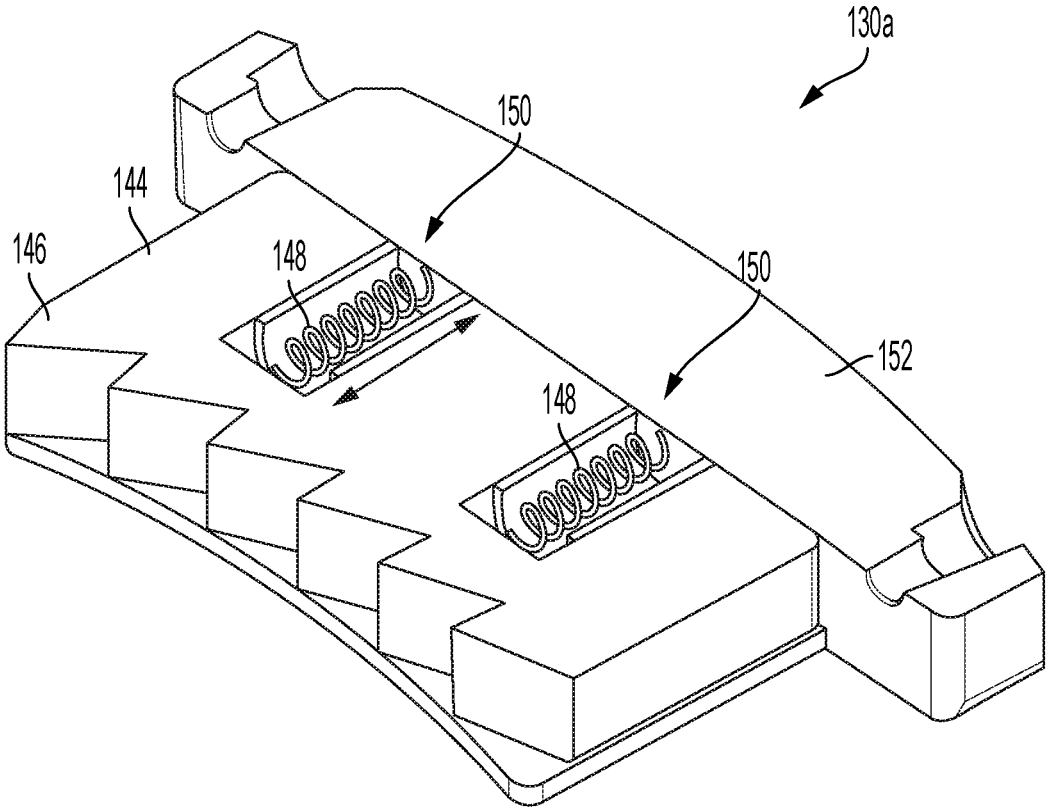

FIG. 9C depicts exemplary first upper ratchet cartridge 130*a*. First upper ratchet cartridge 130*a* illustrated here is exemplary of any ratchet cartridges 130. First upper ratchet cartridge 130*a* comprises ratchet cartridge body 144 comprising ratchet cartridge teeth 146 configured to interact with upper ring teeth 142 as described in detail above and illustrated in FIG. 7B. Ratchet cartridge teeth 146 may be operable by springs 148 provided in spring recesses 150 where the arrows illustrate the action of the springs 148 providing resistance to compression but allowing ratchet cartridge body 144 to slide into cartridge housing 152. For example, as ratchet cartridge teeth 146 move across upper ring teeth 142 (in the counterclockwise direction as described above) the springs 148 compress allowing ratchet cartridge body 144 to slide into cartridge housing 152. As such, as upper ratchet ring 126 rotates in the exemplary counterclockwise direction, springs 148 compress due to the force exerted on the angled side of cartridge teeth 146 and upper ratchet ring 126 rotates relative to upper ring housing 92.

Similarly, or alternatively, when lower ratchet ring 128 is forced in the opposite direction (e.g., clockwise direction), the flat side cartridge teeth 146 of lower ratchet cartridge 130*c* imparts a force to the flat side of lower ratchet teeth ring teeth 140. As lower ratchet ring 128 is coupled to inner body 109, the entire system (including inner body 109 and longitudinal structure 68) is rotated in the clockwise direction when force is applied by actuators 134.

Figure 10:
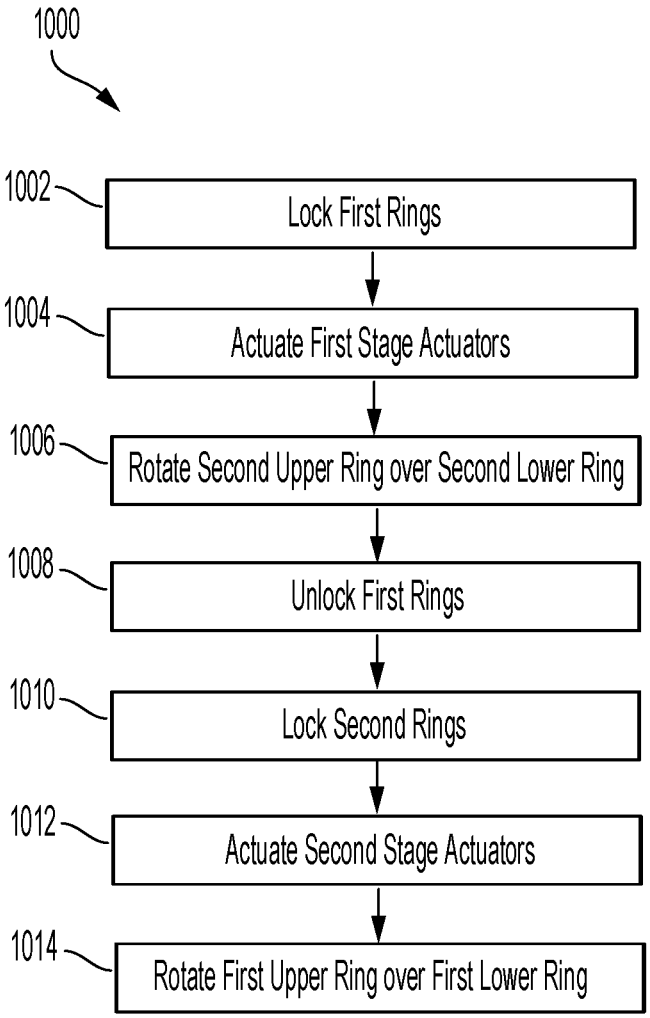
FIG. 10 illustrates an exemplary method of operation of the infinite rotation ratchet assembly relating to some embodiments of the present disclosure.

FIG. 10 depicts a flow chart illustrating a method of rotating the tubing hanger 28 using the infinite rotation ratchet assembly 34 generally referenced by the reference numeral 1000. At step 1002, outer brake 110 is engaged with lower outer ring 96 providing a stationary surface (e.g., first stage plate structure 74) for first stage actuators 72 to press against. As outer brake 110 engages lower outer ring 96, lower outer ring 96 is locked in place with lower outer teeth 98 locking upper outer teeth 86 in place as illustrated in FIG. 7B.

At step 1004, first stage actuators 72 are actuated pressing against the locked first stage plate structure 74 thereby rotating tubing hanger coupling structure 70, longitudinal structure 68, and tubing hanger 28 through a full stroke of first stage actuators 72. First stage actuators 72 are illustrated herein as a linear hydraulic actuator; however, first stage actuators 72 may be any actuators including electric, pneumatic, or magnetic, as well as combinations thereof.

At step 1006, which occur simultaneously or in reaction to step 1004, as first stage actuators 72 rotate tubing hanger coupling structure 70, upper inner teeth 90 of upper inner ring 88 engage lower inner teeth 102 of lower inner ring 100 on the angled side providing lateral and vertical force components. The vertical force component is operable to compress the inner spring 106 allowing upper inner ring 88 to rotate thereby allowing tubing hanger coupling structure 70 to rotate with the stroke of first stage actuators 72.

At step 1008, once first stage actuators 72 have reached the full stroke and stopped, the outer brake 110 of brake assembly 36 is disengaged. As described above, outer brake 110 can be disengaged by retracting brake piston 114 into brake cylinder 118.

At step 1010, inner brake 108 of brake assembly 36 is actuated to engage and lock lower inner ring 100 into upper inner ring 88 thereby locking second stage actuators 76 and tubing hanger coupling structure 70. Inner brake 108 can be actuated by energizing brake cylinder 118 forcing brake piston 114 into a lower surface of lower inner ring 100.

At step 1012, second stage actuators 76 are actuated against second stage plate structures 78, which are now locked by the interaction between upper inner ring 88 and lower inner ring 100 locked by inner brake 108. As second stage actuators 76 extend, first stage plate structures 74 move back to the pre-stroke position compressing first stage actuators 72. As upper inner ring 88 is locked, tubing hanger coupling structure 70 is also locked. As such, tubing hanger 28 remains unmoved by the rotation and compression of first stage actuators 72 resetting to the pre-stroke position.

At step 1014, which occurs simultaneously or in reaction to step 1012, upper outer teeth 86 of upper outer ring 84 engage lower outer teeth 98 of lower outer ring 96 on the angled side providing lateral and vertical force components. The vertical force component is operable to compress the outer spring 104 allowing upper outer ring 84 to rotate thereby allowing first stage plate structures 74 to rotate compressing first stage actuators 72 to the pre-stroke position.

Once the second stage actuators 76 are extended to a stop position and the first stage actuators 72 are compressed to the pre-stroke position, the process is finished. The infinite rotation ratchet assembly 34 is now in the stroke start position, and the process can be repeated until the tubing hanger 28 is oriented correctly for placement in the well.

Figure 11:
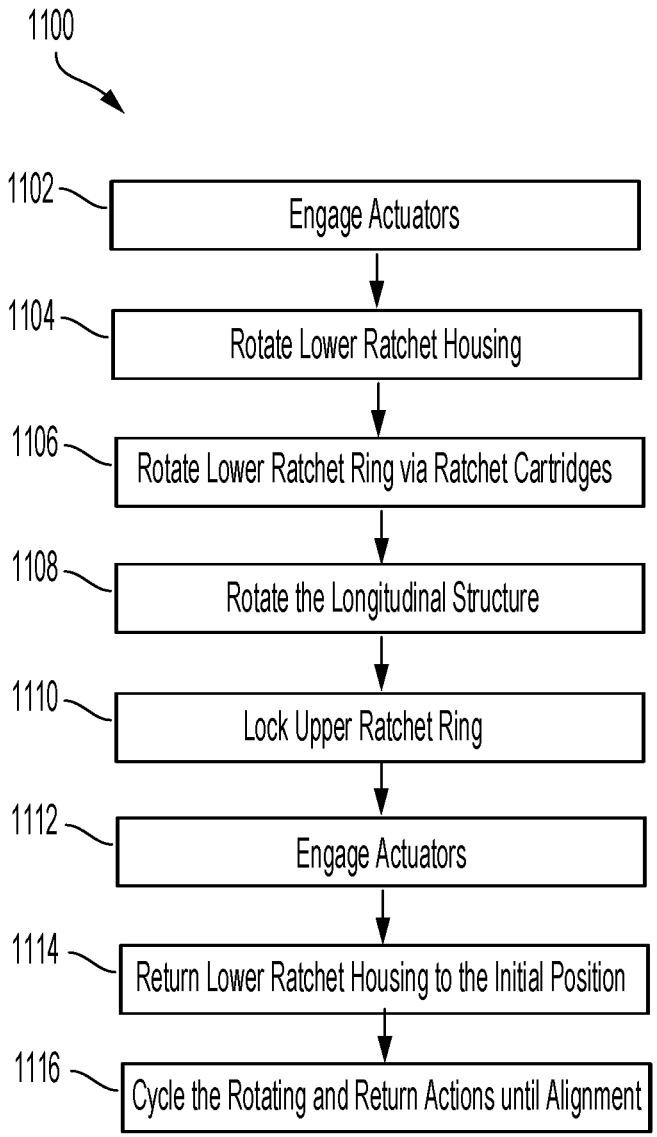
FIG. 11 illustrates an exemplary method of operation fo the rotary configuration of the infinite rotation ratchet assembly relating to some embodiments of the present disclosure.

FIG. 11 depicts a flow chart illustrating a method of rotating the tubing hanger 28 using the radial configuration (FIGS. 9A-9B) of the infinite rotation ratchet assembly 34 generally referenced by the reference numeral 1100. At step 1102, actuators 134 are actuated to rotate inner body 109 in a rotating action. Actuators 134 may be pressurized by forcing fluid into a first side of the double-action piston cylinder. As such, actuators 134 may act against upper ratchet housing brackets 136. As such, actuators 134 force movement, at step 1104, of lower ratchet housing 94 from the initial position via lower ratchet housing brackets 138.

At step 1106, the movement of lower ratchet housing 94 moves lower ratchet ring 128 and upper ratchet ring 126 while upper ratchet housing 92 is maintained. The torque created by actuators 134 rotating lower ratchet housing 94, at step 1108, is transferred through lower ratchet cartridges (e.g., lower ratchet cartridge 130*a*) to lower ratchet ring 128 and, in some embodiments, upper ratchet ring 126 to rotate inner body 109. In turn, at step 1108, inner body 109 transfers the torque to longitudinal structure 68 via keys 131.

At step 1110, upper ratchet ring 126 is locked by brake assembly 36 to prevent rotation of inner body 109 and longitudinal structure 68 to begin the resetting action. Once upper ratchet ring 126 is locked, at step 1112, actuators 134 are actuated by forcing fluid into the second side of the cylinder. The actuators 134 actuate in the opposite direction forcing lower ratchet housing 94 to rotate clockwise back to the initial position at step 1114, before the rotating action began.

At step 1116, the ratcheting action and the return action cycle until longitudinal structure 68 is aligned with the tubing hanger 28. At the end of step 1110, lower ratchet housing 94 and actuators 134 are returned to their initial positions. As such, a new rotating action can begin. The process, including the ratcheting action and the return action, continues cycling until longitudinal structure 68 is aligned with the tubing hanger 28.

The following embodiments represent exemplary embodiments of concepts contemplated herein. Any one of the following embodiments may be combined in a multiple dependent manner to depend from one or more other clauses. Further, any combination of dependent embodiments (e.g., clauses that explicitly depend from a previous clause) may be combined while staying within the scope of aspects contemplated herein. The following clauses are exemplary in nature and are not limiting.

In some aspects, the techniques described herein relate to an infinite rotation ratchet assembly for a subsea tubing hanger orientation module.

In some aspects, the techniques described herein relate to the infinite rotation ratchet assembly including an upper ratchet assembly including: a first upper ring; and a second upper ring.

In some aspects, the techniques described herein relate to the infinite rotation ratchet assembly including a lower ratchet assembly including a first lower ring operational to engage the first upper ring, a second lower ring operational to engage the second upper ring, and a first spring configured to provide a first spring force to the second lower ring to engage the second upper ring.

In some aspects, the techniques described herein relate to the infinite rotation ratchet assembly including a brake assembly configured to lock the first upper ring by pressing the first lower ring into the first upper ring.

In some aspects, the techniques described herein relate to the infinite rotation ratchet assembly wherein when the brake assembly locks the first lower ring into the first upper ring, the second upper ring is configured to rotate relative to the second lower ring by compressing the first spring.

In some aspects, the techniques described herein relate to an infinite rotation ratchet assembly, further including a second spring providing a second spring force; and the first spring is configured to provide the first spring force to the second lower ring to engage the second upper ring, wherein when the brake assembly locks the second lower ring into the second upper ring, the first upper ring is configured to rotate relative to the first lower ring by compressing the second spring.

In some aspects, the techniques described herein relate to an infinite rotation ratchet assembly, further including a tubing hanger coupling structure, wherein the tubing hanger coupling structure is coupled to the second upper ring configured to be locked by the second lower ring.

In some aspects, the techniques described herein relate to an infinite rotation ratchet assembly, wherein the first upper ring includes first upper teeth, and the first lower ring includes first lower teeth configured to engage the first upper teeth, wherein the second upper ring includes second upper teeth, and the second lower ring includes second lower teeth configured to engage the second upper teeth.

In some aspects, the techniques described herein relate to an infinite rotation ratchet assembly, wherein the first lower ring is locked into the first upper ring by forcing, by the first spring, the first lower teeth between the first upper teeth and contacting an upper flat surface of the first upper teeth to a lower flat surface of the first lower teeth when rotational force is applied to the first upper teeth.

In some aspects, the techniques described herein relate to an infinite rotation ratchet assembly, wherein the upper ratchet assembly further includes: a first stage actuator coupled to a tubing hanger coupling structure on a first end and coupled to a first stage plate structure on a second end, wherein a position of the first stage plate structure is locked when the first upper ring is locked by the brake assembly, and wherein the first stage actuator is configured to press against the first stage plate structure to rotate the tubing hanger coupling structure.

In some aspects, the techniques described herein relate to an infinite rotation ratchet assembly, wherein the upper ratchet assembly further includes: a second stage actuator coupled to the first stage plate structure on a first end and coupled to a second stage plate structure on a second end, wherein the second stage actuator is configured to rotate the first stage plate structure to a pre-stroke configuration by pressing on the second stage plate structure when the second upper ring is locked by the brake assembly.

In some aspects, the techniques described herein relate to an infinite rotation ratchet assembly, wherein the tubing hanger coupling structure is coupled to a longitudinal structure that is coupled to a tubing hanger, and wherein the tubing hanger rotates when the tubing hanger coupling structure is rotated by the first stage actuator.

In some aspects, the techniques described herein relate to an infinite rotation ratchet assembly, wherein the first stage plate structure is configured to rotate to the pre-stroke configuration while the tubing hanger coupling structure is secured thereby providing a plurality of rotations to the tubing hanger coupling structure by the first stage actuator.

In some aspects, the techniques described herein relate to an infinite rotation ratchet assembly for a subsea tubing hanger orientation module, the infinite rotation ratchet assembly including: an upper ratchet assembly including: a first upper ring configured to rotate when actuated by a first stage actuator; and a second upper ring configured to rotate when actuated by a second stage actuator; a lower ratchet assembly including: a first lower ring operational to engage the first upper ring; a second lower ring operational to engage the second upper ring; and a spring configured to provide a spring force to the first lower ring to engage the first upper ring; and a brake assembly configured to lock the second upper ring by pressing second lower ring teeth of the second lower ring between second upper ring teeth of the second upper ring, wherein when the brake assembly locks the second lower ring into the second upper ring, the first upper ring is configured to rotate relative to the first lower ring by compressing the spring.

In some aspects, the techniques described herein relate to an infinite rotation ratchet assembly, wherein the first upper ring includes first upper ring teeth, and the first lower ring includes first lower ring teeth configured to engage the first upper ring teeth, and wherein the first upper ring teeth force the first lower ring teeth to compress the spring when the first upper ring is rotated.

In some aspects, the techniques described herein relate to an infinite rotation ratchet assembly, further including a tubing hanger coupling structure, wherein the second upper ring is coupled to the tubing hanger coupling structure and the second upper ring rotates relative to the second lower ring when the first stage actuator is actuated.

In some aspects, the techniques described herein relate to an infinite rotation ratchet assembly, wherein the tubing hanger coupling structure is configured to be coupled to a longitudinal structure, wherein the longitudinal structure is configured to be couple to a tubing hanger thereby orienting the tubing hanger when the tubing hanger coupling structure is rotated by the first stage actuator.

In some aspects, the techniques described herein relate to an infinite rotation ratchet assembly, wherein the first stage actuator is a linear actuator and is configured to rotate the tubing hanger coupling structure approximately forty degrees.

In some aspects, the techniques described herein relate to a method of actuating an infinite rotation ratchet assembly of a subsea tubing hanger orientation module, the method including: locking a first stage plate structure by engaging a first lower ring with a first upper ring using a brake assembly; actuating a first stage actuator from a pre-stroke configuration to press against the first stage plate structure thereby rotating a tubing hanger coupling structure; locking a second stage plate structure by engaging a second lower ring with a second upper ring using the brake assembly; and actuating a second stage actuator to press against the second stage plate structure thereby rotating the first stage plate structure thereby returning the first stage actuator to the pre-stroke configuration.

In some aspects, the techniques described herein relate to a method, further including: engaging first lower ring teeth of the first lower ring with first upper ring teeth of the first upper ring to lock the first stage plate structure; and engaging second lower ring teeth of the second lower ring with second upper ring teeth of the second upper ring to compress a first spring of the second lower ring allowing the second upper ring teeth to slide over the second lower ring teeth providing the tubing hanger coupling structure rotation.

In some aspects, the techniques described herein relate to a method, further including: engaging the second lower ring teeth of the second lower ring with the second upper ring teeth of the second upper ring to lock the second stage plate structure and the tubing hanger coupling structure; and engaging the first lower ring teeth of the first lower ring with the first upper ring teeth of the first upper ring to compress a second spring of the first lower ring allowing the first upper ring teeth to slide over the first lower ring teeth allowing the first stage plate structure to rotate thereby returning the first stage actuator to the pre-stroke configuration.

In some aspects, the techniques described herein relate to a method, wherein the tubing hanger coupling structure is configured to be coupled to a longitudinal structure, wherein the longitudinal structure is configured to be couple to a tubing hanger thereby orienting the tubing hanger when the tubing hanger coupling structure is rotated by the first stage actuator.

In some aspects, the techniques described herein relate to a method, wherein the first stage actuator is a linear actuator and is configured to rotate the tubing hanger coupling structure approximately forty degrees.

In some aspects, the techniques described herein relate to a method, wherein the second upper ring is coupled to the tubing hanger coupling structure and the second upper ring rotates relative to the second lower ring when the first stage actuator is actuated.

Although the present disclosure has been described with reference to the embodiments illustrated in the attached drawing figures, it is noted that equivalents may be employed, and substitutions made herein without departing from the scope of the present disclosure as recited in the claims.

What is claimed is:

1. An infinite rotation ratchet assembly for a subsea tubing hanger orientation module, the infinite rotation ratchet assembly comprising:

an upper ratchet assembly comprising:

a first upper ring; and a second upper ring;

a lower ratchet assembly comprising:

a first lower ring operational to engage the first upper ring;

a second lower ring operational to engage the second upper ring; and a first spring configured to provide a first spring force to the second lower ring to engage the second upper ring; and a brake assembly configured to lock the first upper ring by pressing the first lower ring into the first upper ring, wherein when the brake assembly locks the first lower ring into the first upper ring, the second upper ring is configured to rotate relative to the second lower ring by compressing the first spring.

2. The infinite rotation ratchet assembly of claim 1, further comprising:

a second spring providing a second spring force; and the first spring is configured to provide the first spring force to the second lower ring to engage the second upper ring, wherein when the brake assembly locks the second lower ring into the second upper ring, the first upper ring is configured to rotate relative to the first lower ring by compressing the second spring.

3. The infinite rotation ratchet assembly of claim 2, further comprising a tubing hanger coupling structure, wherein the tubing hanger coupling structure is coupled to the second upper ring configured to be locked by the second lower ring.

4. The infinite rotation ratchet assembly of claim 2, wherein the first upper ring comprises first upper teeth and the first lower ring comprises first lower teeth configured to engage the first upper teeth, wherein the second upper ring comprises second upper teeth, and the second lower ring comprises second lower teeth configured to engage the second upper teeth.

5. The infinite rotation ratchet assembly of claim 4, wherein the first lower ring is locked into the first upper ring by forcing, by the second spring, the first lower teeth between the first upper teeth, and contacting an upper flat surface of the first upper teeth to a lower flat surface of the first lower teeth when rotational force is applied to the first upper teeth.

6. The infinite rotation ratchet assembly of claim 2, wherein the upper ratchet assembly further comprises:

a first stage actuator coupled to a tubing hanger coupling structure on a first end and coupled to a first stage plate structure on a second end, wherein a position of the first stage plate structure is locked when the first upper ring is locked by the brake assembly, and wherein the first stage actuator is configured to press against the first stage plate structure to rotate the tubing hanger coupling structure.

7. The infinite rotation ratchet assembly of claim 6, wherein the upper ratchet assembly further comprises:

a second stage actuator coupled to the first stage plate structure on a first end and coupled to a second stage plate structure on a second end, wherein the second stage actuator is configured to rotate the first stage plate structure to a pre-stroke configuration by pressing on the second stage plate structure when the second upper ring is locked by the brake assembly.

8. The infinite rotation ratchet assembly of claim 7, wherein the tubing hanger coupling structure is coupled to a longitudinal structure that is coupled to a tubing hanger, and wherein the tubing hanger rotates when the tubing hanger coupling structure is rotated by the first stage actuator.

9. The infinite rotation ratchet assembly of claim 8, wherein the first stage plate structure is configured to rotate to the pre-stroke configuration while the tubing hanger coupling structure is secured thereby providing a plurality of rotations to the tubing hanger coupling structure by the first stage actuator.

10. An infinite rotation ratchet assembly for a subsea tubing hanger orientation module, the infinite rotation ratchet assembly comprising:

an upper ratchet assembly comprising:

a first upper ring configured to rotate when actuated by a first stage actuator; and a second upper ring configured to rotate when actuated by a second stage actuator;

a lower ratchet assembly comprising:

a first lower ring operational to engage the first upper ring;

a second lower ring operational to engage the second upper ring; and a spring configured to provide a spring force to the first lower ring to engage the first upper ring; and a brake assembly configured to lock the second upper ring by pressing second lower ring teeth of the second lower ring between second upper ring teeth of the second upper ring, wherein when the brake assembly locks the second lower ring into the second upper ring, the first upper ring is configured to rotate relative to the first lower ring by compressing the spring.

11. The infinite rotation ratchet assembly of claim 10, wherein the first upper ring comprises first upper ring teeth and the first lower ring comprises first lower ring teeth configured to engage the first upper ring teeth, and wherein the first upper ring teeth force the first lower ring teeth to compress the spring when the first upper ring is rotated.

12. The infinite rotation ratchet assembly of claim 10, further comprising a tubing hanger coupling structure, wherein the second upper ring is coupled to the tubing hanger coupling structure and the second upper ring rotates relative to the second lower ring when the first stage actuator is actuated.

13. The infinite rotation ratchet assembly of claim 12, wherein the tubing hanger coupling structure is configured to be coupled to a longitudinal structure, wherein the longitudinal structure is configured to be couple to a tubing hanger thereby orienting the tubing hanger when the tubing hanger coupling structure is rotated by the first stage actuator.

14. The infinite rotation ratchet assembly of claim 13, wherein the first stage actuator is a linear actuator, and the linear actuator is configured to rotate the tubing hanger coupling structure approximately forty degrees.

15. A method of actuating an infinite rotation ratchet assembly of a subsea tubing hanger orientation module, the method comprising:

locking a first stage plate structure by engaging a first lower ring with a first upper ring using a brake assembly;

actuating a first stage actuator from a pre-stroke configuration to press against the first stage plate structure thereby rotating a tubing hanger coupling structure;

locking a second stage plate structure by engaging a second lower ring with a second upper ring using the brake assembly; and actuating a second stage actuator to press against the second stage plate structure thereby rotating the first stage plate structure thereby returning the first stage actuator to the pre-stroke configuration.

16. The method of claim 15, further comprising:

engaging first lower ring teeth of the first lower ring with first upper ring teeth of the first upper ring to lock the first stage plate structure; and engaging second lower ring teeth of the second lower ring with second upper ring teeth of the second upper ring to compress a first spring of the second lower ring allowing the second upper ring teeth to slide over the second lower ring teeth providing the tubing hanger coupling structure rotation.

17. The method of claim 16, further comprising:

engaging the second lower ring teeth of the second lower ring with the second upper ring teeth of the second upper ring to lock the second stage plate structure and the tubing hanger coupling structure; and engaging the first lower ring teeth of the first lower ring with the first upper ring teeth of the first upper ring to compress a second spring of the first lower ring allowing the first upper ring teeth to slide over the first lower ring teeth allowing the first stage plate structure to rotate thereby returning the first stage actuator to the pre-stroke configuration.

18. The method of claim 15, wherein the tubing hanger coupling structure is configured to be coupled to a longitudinal structure, wherein the longitudinal structure is configured to be couple to a tubing hanger thereby orienting the tubing hanger when the tubing hanger coupling structure is rotated by the first stage actuator.

19. The method of claim 18, wherein the first stage actuator is a linear actuator and is configured to rotate the tubing hanger coupling structure approximately forty degrees.

20. The method of claim 15, wherein the second upper ring is coupled to the tubing hanger coupling structure and the second upper ring rotates relative to the second lower ring when the first stage actuator is actuated.

* * * * *